US005768900A

United States Patent [19]

Lee

[11] Patent Number: 5,768,900

[45] Date of Patent: Jun. 23, 1998

[54] ICE MAKER HAVING STOPS FOR CONTROLLING THE POSITION OF A ROTARY ICE-MAKING TRAY

[75] Inventor: Gun Il Lee, Seoul, Rep. of Korea

[73] Assignee: Samsung Electronics Co., Ltd., Suwon, Rep. of Korea

[21] Appl. No.: 757,548

[22] Filed: Nov. 27, 1996

[30] Foreign Application Priority Data

Dec. 22, 1995 [KR] Rep. of Korea ..... 95-54788
Dec. 22, 1995 [KR] Rep. of Korea ..... 95-54790

[51] Int. Cl.[6] ..... F25C 5/06

[52] U.S. Cl. ..... 62/137; 62/353

[58] Field of Search ..... 62/137, 353

[56] References Cited

U.S. PATENT DOCUMENTS 3,269,139 8/1966 De Vincent ..... 62/137
3,308,631 3/1967 Kniffin ..... 62/137
3,383,876 5/1968 Frohbieter ..... 62/137
3,540,227 11/1970 Eyman, Jr. et al. ..... 62/137
3,863,461 2/1975 Bright ..... 62/137
4,628,699 12/1986 Mawby et al. ..... 62/137

*Primary Examiner*—William E. Tapolcai
*Attorney, Agent, or Firm*—Burns, Doane, Swecker & Mathis, L.L.P.

[57] ABSTRACT

An automatic ice maker adapted for use in a refrigerator includes an ice-making container rotatable between an upright ice-making position and an inverted ice-discharging position by a motor. A reservoir is disposed beneath the container to receive the discharged ice. The position of the container is determined by switches which are actuated by cams that rotate with the container. Signals from the switches are fed to a controller which stops and starts the motor and determines the direction of motor rotation. In order to prevent excessive overtravel of the container, e.g., in the case of switch malfunction, stops are provided which stop the rotation of the container independently of the controller.

5 Claims, 8 Drawing Sheets

ICE MAKER HAVING STOPS FOR CONTROLLING THE POSITION OF A ROTARY ICE-MAKING TRAY

RELATED INVENTIONS

This invention is related to inventions disclosed in U.S. application Ser. No. 08/755,540 of Gun II Lee and Jae Eok Shim, filed Nov. 21, 1996, and U.S. application Ser. No. 08/757,753 of Kun Bin Lee and Jae Eok Shim filed Nov. 26, 1996.

FIELD OF THE INVENTION

The present invention relates generally to an ice maker for a refrigerator. More particularly, it relates to an ice maker mechanism which controls the rotation of an ice-making tray.

BACKGROUND OF THE INVENTION

FIG. 3 depicts a refrigerator having a conventional. ice maker. This refrigerator includes a body 1, and a freezing compartment 3 and refrigerating compartment 4 which are separated by a partition 2. The freezing and refrigerating compartments 3 and 4 are accessible by the opening of two doors 5 and 6 to the freezing compartment 3 and refrigerating compartment 4, respectively. A cooler 7, which cools air, is provided behind the freezing compartment 3. The cold air from the cooler 7 is forcedly circulated within the freezing compartment 3 and refrigerating compartment 4 by a fan 8 installed above the cooler 7. In order to guide the flow of this cold air, a front plate 9 and a rear plate 10 are installed in front of and adjacent to the fan 8, respectively. Formed in the front plate 9 is an outlet 11 which discharges the cold air into the freezing compartment 3, and at the rear plate 10 there originates a duct 12 which supplies the cold air into the refrigerating compartment An ice maker 20, mounted in the freezing compartment 3, utilizes the cold air generated by the cooler 7 to turn water into ice. The ice maker 20 consists of an ice making tray or container 21 having a plurality of concave portions 21'which hold the water as it freezes and an ice reservoir 22 which stores ice cubes made in the ice making container 21. Further, a water reservoir 23, a water supply pump 24, and a hose 25 are provided for supplying water from the water reservoir 23 in the refrigerating compartment 4 to the ice making container 21. The hose 25 is disposed to extend from the water reservoir 23 to the upper portion of the ice making container 21. Through the hose 25 the water from the water reservoir 23 is fed to the ice making container 21. An operating member 26 is provided at the front of the ice making container 21, and serves to cause the ice cubes inside the ice making container 21 to be transferred into the ice reservoir 22 by turning the ice making container 21 approximately 135° and then by twisting it to an additional 15°.

FIG. 4 schematically depicts the overall outward appearance of the conventional ice maker 20 installed in the freezing compartment 3. The ice making container 21 is integrally joined to the operating member 26. The ice reservoir 22 is located under the ice making container 21, and can be removed from the freezing compartment 3 so that the ice cubes may be easily transferred from the freezing compartment 3. The ice making container 21 is rotated about its longitudinal axis by a rotating force generated by an electric motor 30. An ice level checking lever 45 and an ice level checking switch 46 are provided to stop the ice dropping mode when the ice reservoir 22 is filled with ice cubes. In such an ice maker 20, the water supplying, ice making and ice dropping modes are carried. out automatically and sequently by the control of a control portion (not illustrated).

FIG. 6 shows the conventional operating member 26 that performs the ice dropping mode. It includes a motor 30 for generating a rotating force; a pair of reduction gears 33 that transfer and reduce the speed of the rotating force; and a cam gear 35, which meshes with the reduction gears 33, and which is in connection with the ice making container 21 to thereby rotate the ice making container 21.

The operating member 26 also includes first and second horizontal position sensing switches 40 and 41 which are turned on and off according to the rotation of the cam gear 35 to detect whether the ice making container 21 is in a horizontal (upright) or (inverted) position, respectively and an ice level checking lever 45 (refer to FIG. 4) and ice level checking switch 46 which determine if the ice reservoir 22 is full.

As shown in FIGS. 5 and 6, first and second grooves 37 and 38 are formed on the outer circumference of the cam member 36 and are oppositely disposed with respect to each other; the cam member 36, meshes with the cam gear 35. While the first groove 37 is formed on the inner axial end of the cam member 36 in order to cooperate with the first horizontal position sensing switch 40, the second groove 38 is provided on the outer axial end of the cam member 36 to cooperate with the second horizontal position sensing switch 41.

As the cam gear 35 rotates, the first groove 37 comes into proximity with the horizontal position sensing switch 40 so as to turn it off, while the second horizontal position sensing switch 41 remains on. When the second groove 38 comes into proximity with the second horizontal position sensing switch 41, the switch 41 is turned off while the first horizontal position sensing switch 40 remains on.

The control portion (not illustrated) controls the execution of the ice dropping mode by determining the position of the moving ice making container 21 according to combined signals of the first and second horizontal position sensing switches 40 and 41. More specifically, when the first horizontal position sensing switch 40 is off and the second horizontal position sensing switch 41 is on, the control portion determines that the ice making container 21 is in a horizontal position. Alternatively, when the first and second horizontal position sensing switches 40 and 41 are on and off, respectively,, the control portion determines that the ice making container 21 is twisted at its maximum angle. When both switches 40 and 41 are on, the control portion determines that the ice making container 21 is in the process of turning.

When the ice reservoir 22 is filled with the ice cubes, the ice level checking switch lever 45 turns off the ice level checking switch 46, thereby informing the control portion that the ice reservoir 22 is full. The control portion does not then proceed with the ice dropping mode until the ice level checking switch 46 is turned back on by the depletion of the ice reservoir.

In the conventional operating member 26, the motor 30, which rotates forward and reverse, comes to stop in response to the generation of an output signal from the second horizontal position sensing switch 41 when the ice making container 21 is twisted at its maximum angle. When the ice making container 21 returns to a horizontal position, the motor 30 is stopped by the output signal of the first horizontal position sensing switch 40. In this arrangement, the ice making mode may not be completely executed under certain circumstances.

More specifically, when the first and second horizontal position sensing switches 40 and 41 are off and on respectively and the ice making container 21 is in a horizontal position, once the motor 30 rotates the cam gear 35 for the ice dropping mode, the cam member 36 allows both the switches 40 and 41 to be turned on. If the cam gear 35 continues to rotate a total of 135°, the second groove 38 of the cam member 36 will be located over the second horizontal position sensing switch 41. Accordingly, the second horizontal position sensing switch 41 is turned off, and the control portion (not illustrated) determines that the cam gear 35 is turned at its maximum angle. At this point, the ice making container 21 is twisted to thereby drop ice cubes out of the ice making container 21.

The conventional ice maker 20 does not have means for stopping the motor 30 after the ice making container 21 has twisted maximally, with the exception of the second horizontal position sensing switch 41. Thus, in the case where the second horizontal position sensing switch 41 malfunctions or is defective, the motor 30 continues to rotate beyond the maximum point, possibly breaking the ice making container 21, the cam gear 35 and other components as well as the motor itself.

The converse problem also exists. After the ice making container 21 is turned at its maximum angle to drop the ice cubes into the ice reservoir 22, the motor 30 reverses direction, causing the cam member 36 and the cam gear 35 to also do so. Once the first groove 37 of the cam member 36 comes in contact with the first horizontal position sensing switch 40, the switch 40 is turned off, thereby stopping the motor 30.

The conventional ice maker 20, however, does not have means for stopping the motor 30 when the ice making container 21 is at a horizontal position, with the exception of the first horizontal position sensing switch 40. Thus, in the case where the first horizontal position sensing switch 40 malfunctions or is defective, the motor 30 continues to rotate, possibly breaking the ice making container 21, the cam gear 35 and other components as well as the motor 30 itself.

Based on the above and foregoing, it can be appreciated that there presently exists a need in the art for an ice maker for a refrigerator which overcomes the above-described disadvantages, drawbacks, and shortcomings of presently available systems. The present invention fulfills this need.

SUMMARY OF THE INVENTION

It is the first objective of the present invention to provide an ice maker for a refrigerator in which a motor can stop its operation with safety, even if a cam gear continues to rotate a container beyond a maximum angle of rotation due to the erroneous operation of a switch during an ice dropping mode.

It is the second objective of the present invention to provide an ice maker in which a motor can stop its operation with safety, even if a cam gear continues to rotate the container beyond a horizontal stop point due to the erroneous operation of switches during ice dropping a container return mode.

In order to obtain these objectives, there is provided an ice maker for a refrigerator with a freezing compartment and a refrigerating compartment, including: a motor generating a rotating force used to rotate and twist an ice making container housed in the freezing compartment so as to drop ice cubes made in the ice making container into an ice reservoir disposed under the ice making container; a reduction gear assembly and a cam gear which rotate the ice making container by using the rotating force generated by the motor; and a horizontal position sensing switch turned on or off by the rotation of the cam gear in order to control the ice making mode.

The inventive ice maker also includes an ice level checking switch turned on or off by the rotational position of the cam gear in order to control the quantity of the ice cubes contained in the ice reservoir; an ice level checking lever whose position is determined by the amount of ice in the ice reservoir; and rotation stopping means preventing the cam gear from continuing to rotate beyond its stop points.

The above rotation stopping means consists of a first stopper preventing the cam gear from rotating beyond its maximum angle of rotation; a second stopper preventing the cam gear from rotating beyond its horizontal stop point; and a catch protruding from the cam gear. Thus, in the case where either the horizontal position sensing switch or the ice level checking switch fails to operate normally, the catch abuts the first or second stopper and stops the cam gear from rotating.

The first stopper is disposed to be slightly beyond the position of the catch when the cam gear is at its maximum point of rotation. The second stopper is disposed to be slightly beyond the position of the catch when the cam gear is in the position corresponding to the horizontal position of the ice making container.

BRIEF DESCRIPTION OF THE DRAWINGS

FIGS. 2A to 2E are sectional views of an operating member of the inventive ice maker in different stages of operation as taken along line 2—2 in FIG. 1, wherein FIG. 2A depicts a state where the ice making container is in the horizontal ice making position, FIGS. 2B shows a state where the ice making container is in an intermediate stage of turning, FIG. 2C shows a state where the ice making container is in an inverted ice-discharging position, FIG. 2D shows the ice making container whose rotation is limited by a first stopper, and FIG. 2E shows the ice making container whose rotation is limited by the second stopper;

DETAILED DESCRIPTION OF THE PREFERRED EMBODIMENT

The preferred embodiment of the present invention will be now described in detail with reference to the accompanying drawings.

Figure 1:
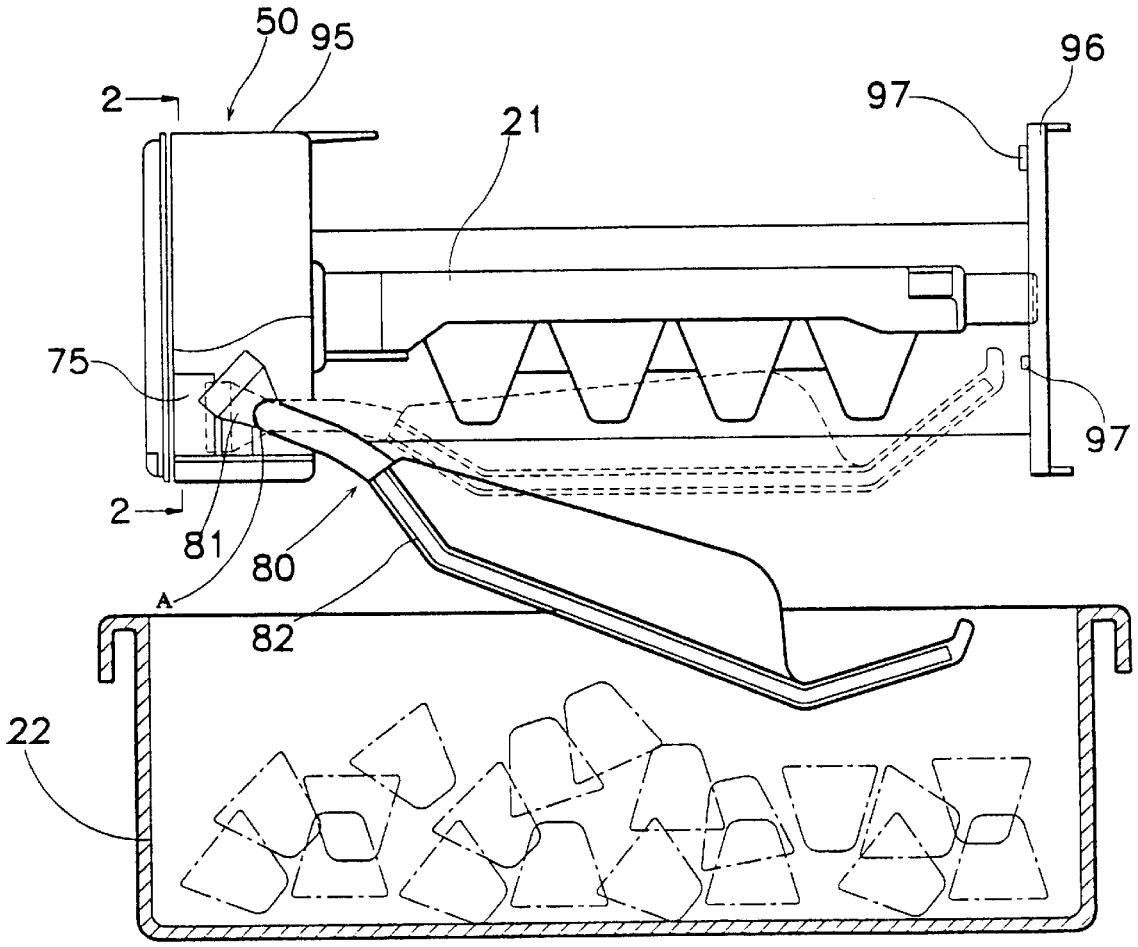
FIG. 1 depicts a side view of an ice maker according to the present invention.

FIG. 1 depicts the overall outward appearance of an ice maker according to the present invention.

Figure 2A:
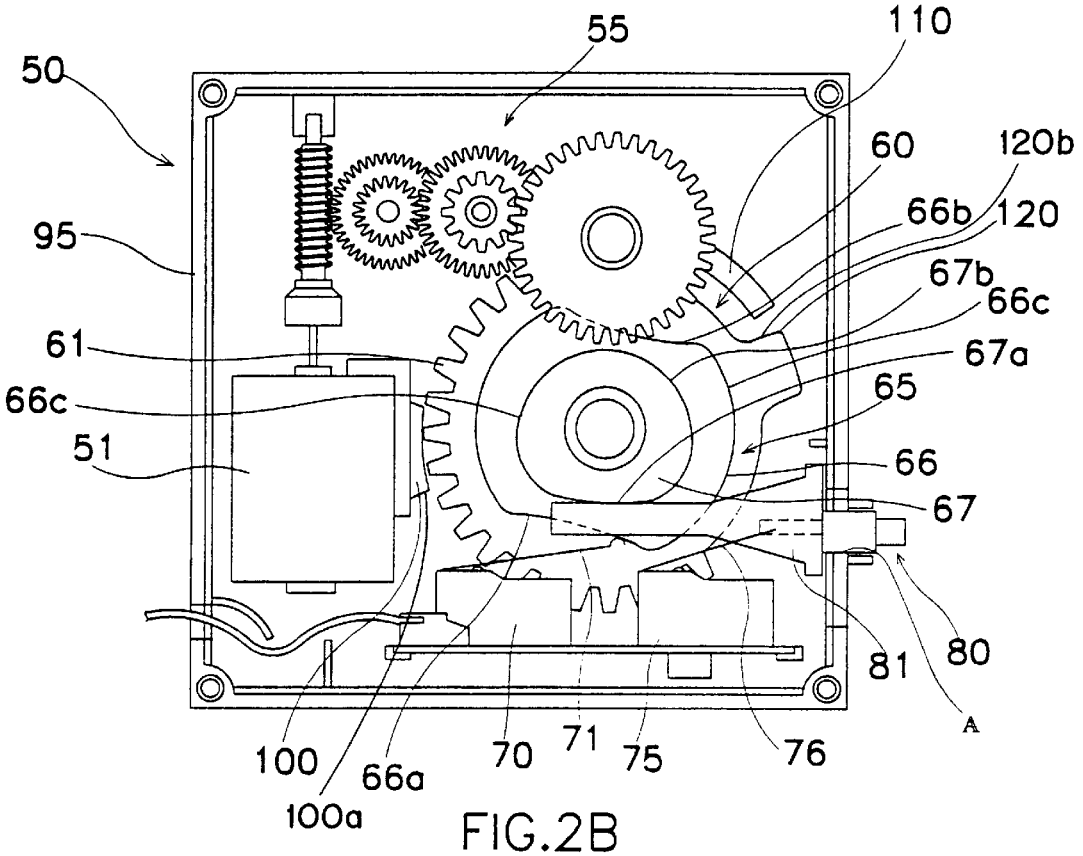

FIG. 2A depicts an operating member 50 when its ice making container 21 is in the horizontal position.

The operating member 50 of the inventive ice maker includes the following components in a case 95: a motor 51 which generates a rotating force; a drive transmission mechanism which includes a reduction gear assembly 55 which reduces the rotation speed of the motor 51 and delivers the rotating force of the motor 51 to an ice making container 21(FIG. 1); and a cam gear 60 which meshes with the reduction gear assembly 55 and is in shaft-connection with the ice making container 21 thereby enabling it to twist the container 21.

The operating member 50 also includes a horizontal position sensing switch 70 and an ice level checking switch 75, the latter serving to control its ice dropping mode and ice level checking mode. An ice level checking lever 80 assists the function of the ice level checking switch 75 by being moved up and down depending on the quantity of ice cubes in an ice reservoir 22 so as to operate the ice level checking switch 75.

The cam gear 60 consists of a gear 61 and a cam member 65 integral with the gear 61. A first cam 66 is formed on the cam member 65 to operate the horizontal position sensing switch 70, and a second cam 67 is also formed on the cam member 65 to operate the ice level checking switch 75. The first cam 66 has a first concave portion 66*a* and a second concave portion 66*b* oppositely disposed respective to each other on its outer surface, and two rounded portions 66*c* formed on the outer surface where the first and second concave portions 66*a* and 66*b* are not formed.

The horizontal position sensing switch 70 is arranged to be turned off when its lever 71, during the rotation of the first cam 66, comes in contact with the first or second concave portions 66*a* and 66*b*, and turned on when its lever 71 is in contact with the rounded portion 66*c*. The second cam 67 is semicircular in shape and has a flat portion 67*a* and a rounded portion 67*b*. The ice level checking switch 75 is turned off when its lever 76 is in contact with the flat portion 67*a* during the rotation of the second cam 67, and is turned on when the lever 76 contacts the rounded portion 67*b*.

Figure 2B:
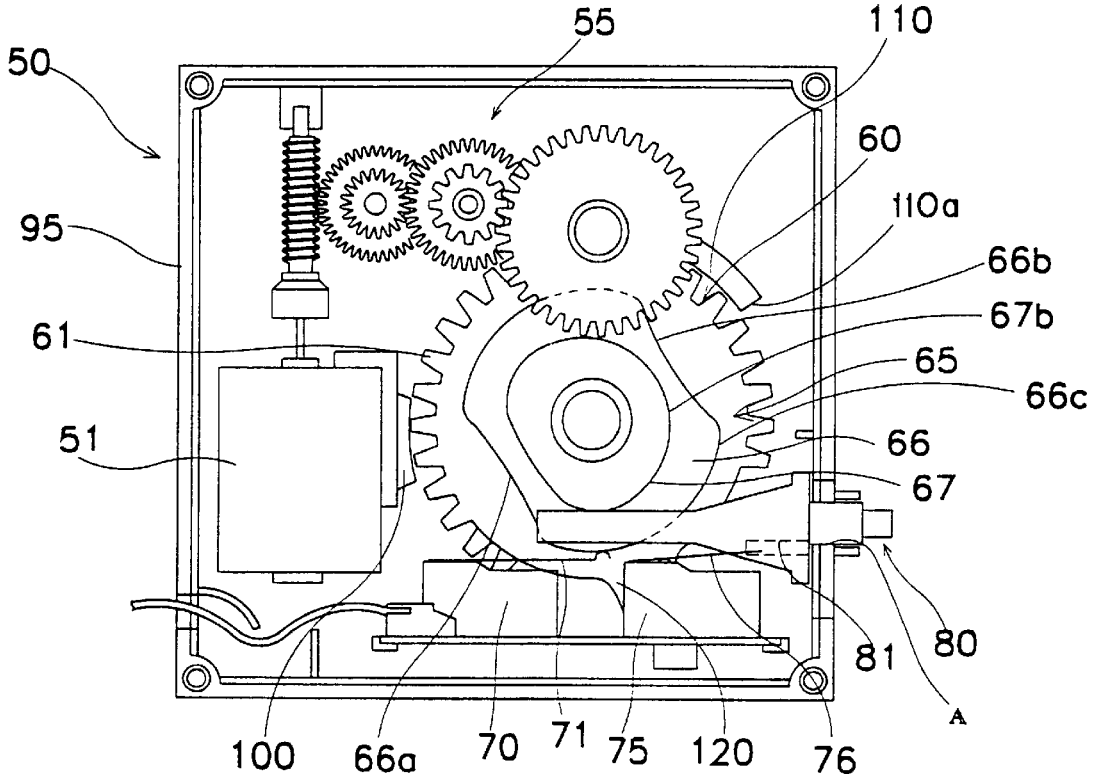
Figure 2C:
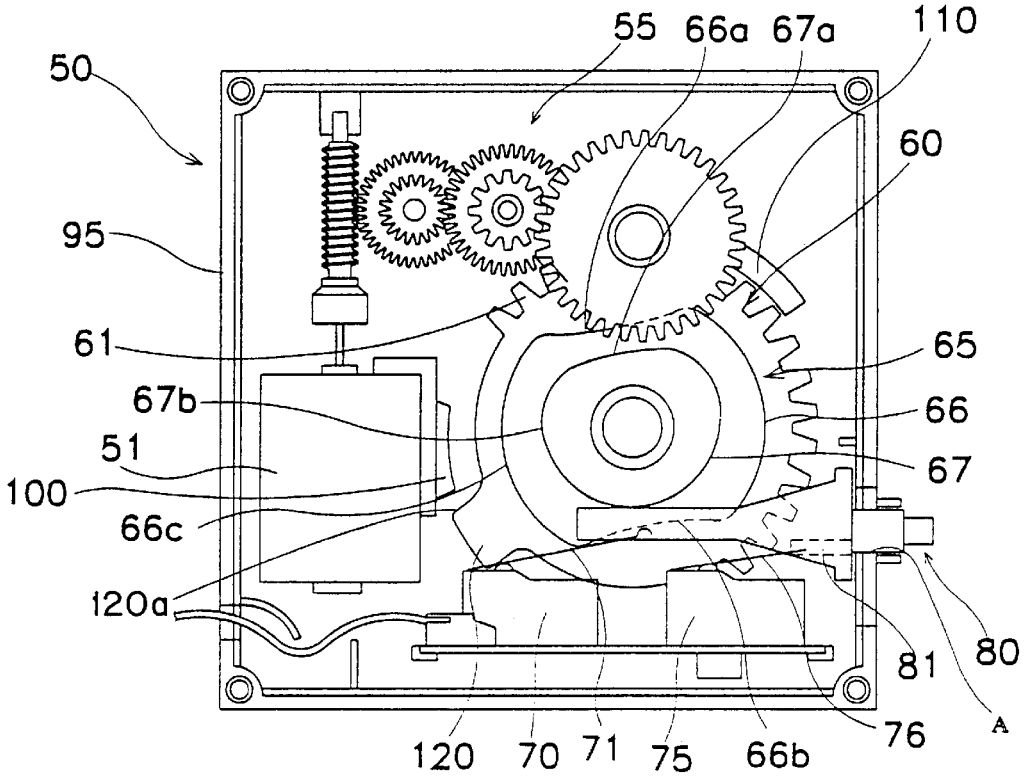

Rotation stopping means, the feature of the present invention, includes a catch 120 extending outward from the gear 61, a first stopper 100 forming a first stationary stop surface 100*a* and a second stopper 110, second stationary stop surface 110*a* insert both of which are formed in the case 95. The first stop surface 100*a* of the first stopper 100, as shown in FIG. 2C, is disposed slightly beyond the position of a third stop surface 120*a* of the catch 120 formed on the cam gear 60 when the cam gear 60 is turned at its maximum angle. As shown in FIG. 2A, the second stop surface 110*a* of the second stopper 110 is disposed slightly beyond the position of the fourth stop surface 120*b* of the catch 120 formed on the cam gear 60 when the cam gear 60 is in the position corresponding to the horizontal (upright) position of the ice making container 21.

The ice level checking lever 80 includes a first arm member 81 and a second arm member 82 which are rotated about the axis A in the opposite direction to each other. The first arm member 81 is disposed between the second cam 67 and the ice level checking switch 75. The ice level checking switch 75 is turned on and off as the first arm member 81 is moved up and down respectively, with the rotation of the first cam 67. The ice making container 21 has one end connected to the cam gear 60 and the other end rotatably held by a support 96 integrally coupled with the case 95 of the operating member 50. The support 96 has a plurality of protrusions 97 which stop its end of the ice making container 21 from rotating after the cam member 65 has rotated the entire container 21 by 135°. The cam member 65 then continues to rotate its end of the ice making container 21 approximately an additional 15°, thereby twisting the container 21 and causing it to drop its ice cubes into the ice reservoir 22.

When the amount of ice cubes in the ice reservoir 22 reaches a predetermined level, the second arm member 82 of the ice level checking lever 80 rests on top of the ice in the ice reservoir 22. In other words, it is angled downward with respect to the axis A, and the first arm member 81 is angled upward. At this point, when the ice making container 21 is in a horizontal position, the ice level checking switch 75 is turned off.

When the amount of ice cubes exceeds a predetermined level, the second arm member 82 is raised (as indicated by the dotted line in FIG.1) and the first arm member 81 is moved downward so that the ice level checking switch 75 is turned on. The control portion (not illustrated) interprets this as meaning that the ice reservoir 22 being filled to capacity with ice cubes.

The following description relates to the operation of the operating member 50 of the inventive ice maker.

FIG. 2A depicts the location of the cam gear 60 when the ice making container 21 is in the horizontal position.

In this circumstance, the lever 71 of the horizontal position sensing switch 70 comes in contact with the first concave portion 66*a* of the first cam 66 to thereby turn off the switch 70. The first arm member 81 of the ice level checking lever 80, positioned over the lever 76 of the ice level checking switch 75, contacts the flat portion 67*a* of the second cam 67 to thereby turn off the ice level checking switch 75. Referring to this, the control portion (not illustrated) determines that the ice making container 21 is in the horizontal position. After the ice making mode is completed, the control portion powers, the motor 51 so that the cam gear 60 rotates clockwise as shown in FIG. 2B.

As the cam gear 60 rotates, the rounded portion 66*c* of the first cam 66 depresses the lever 71 of the horizontal position sensing switch 70 to thereby turn it on. When the cam gear 60 continues its rotation to the position depicted in FIG. 2C, the rounded portion 67*b* of the second cam 67 makes the first arm member 81 of the ice level checking lever 80 depress the ice level checking switch 75, thereby turning it on. Both switches 70,75 being on is interpreted by the control portion as meaning that the ice making container 21 is rotating.

As shown in FIG. 2C, when the cam gear 60 continues to rotate to the maximum angle of approximately 135°, the second concave portion 66*b* of the first cam 66 comes in contact with the lever 71 so that the horizontal position sensing switch 70 is turned off again while the ice level checking switch 75 remains on. The control portion interprets this as the ice making container 21 being rotated maximally.

Because the end of the ice making container 21 on the side of the support 96 is restrained from rotating by the protrusions 97, continued operation of motor 51 causes the ice making container 21 to twist to its inverted position thereby dropping its ice cubes into the ice reservoir 22. Once the ice dropping mode is completed, the motor 51 reverses to rotate the cam member 65 to its original position in FIG. 2A by way of the intermediate states of FIGS. 2C and 2B. Consequently, both the switches 70 and 75 are again turned off, serving to inform the control portion that the ice making container 21 has returned to the horizontal position. The control portion stops the motor 51 after the ice dropping mode is completed, and activates a water supply pump 24 to refill the ice making container 21.

When either the horizontal position sensing switch 70 or the ice level checking switch 75 malfunctions while the ice making container 21 has rotated maximally, the control portion cannot determine the maximum point of rotation. Accordingly, the motor 51 does not stop its operation so the cam gear 60 and the ice making container 21 continue to rotate, thereby damaging the ice making container 21, the cam gear 60, the reduction gear assembly 55, and also the motor 51.

Figure 2D:
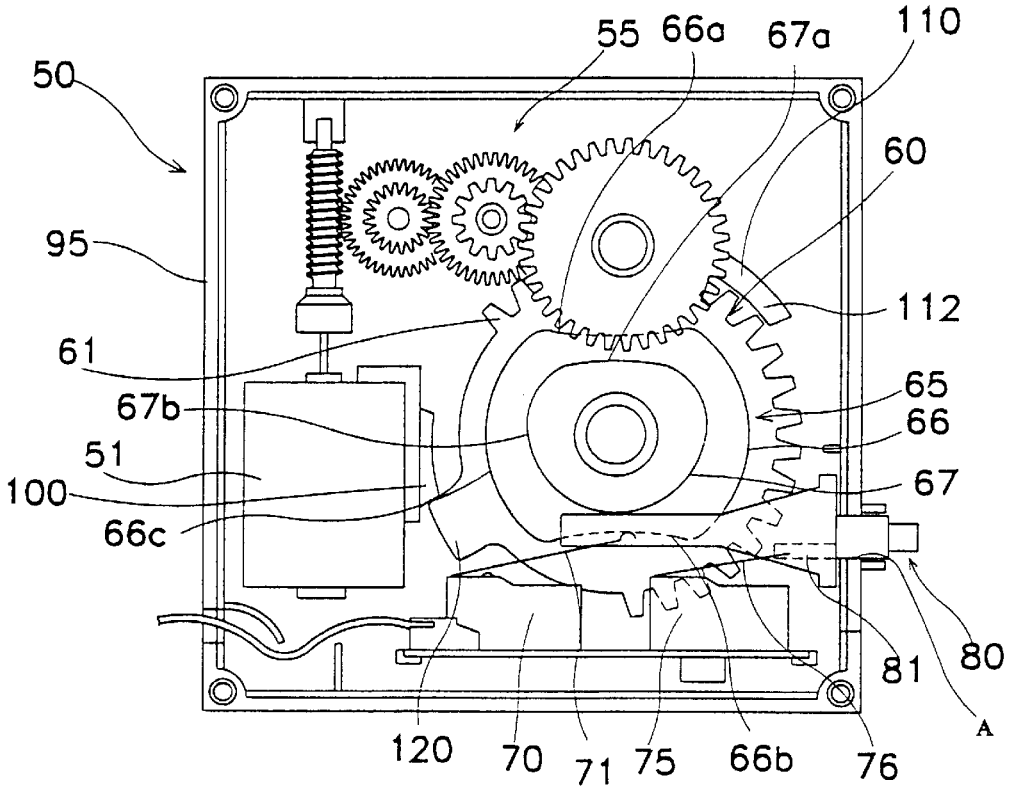

If either or both of the two switches 70 and 75 malfunctions while the ice making container 21 has rotated maximally, the first stopper 100, disposed slightly beyond the location of the cam gear 60 at its point of maximum rotation, prevents the erroneous additional twisting thereof, protecting the ice ,maker 20. In other words, as shown in FIG. 2D, the catch 120 abuts the first stopper 100 so that the cam gear 60 and the ice making container 21 do not rotate any further, thereby preventing the components from getting damaged. At this point, electrical overcurrent flows into the motor 51, (i.e., an overload condition occurs) and the control portion (not illustrated), which detects this, stops the motor 51.

In addition, after the cam gear 60 has returned to its original position (the state of FIG. 2A), the components may be damaged due to the continuous rotation of the cam gear 60. While the cam gear 60 reverses so as to make the ice making container 21 be in the horizontal position, if either the horizontal position sensing switch 70 or the ice level checking switch 75 malfunctions, the motor 51 does not stop so that each of the cam gear 60 and the ice making container 21 continues to turn beyond its horizontal stop point.

Figure 2E:
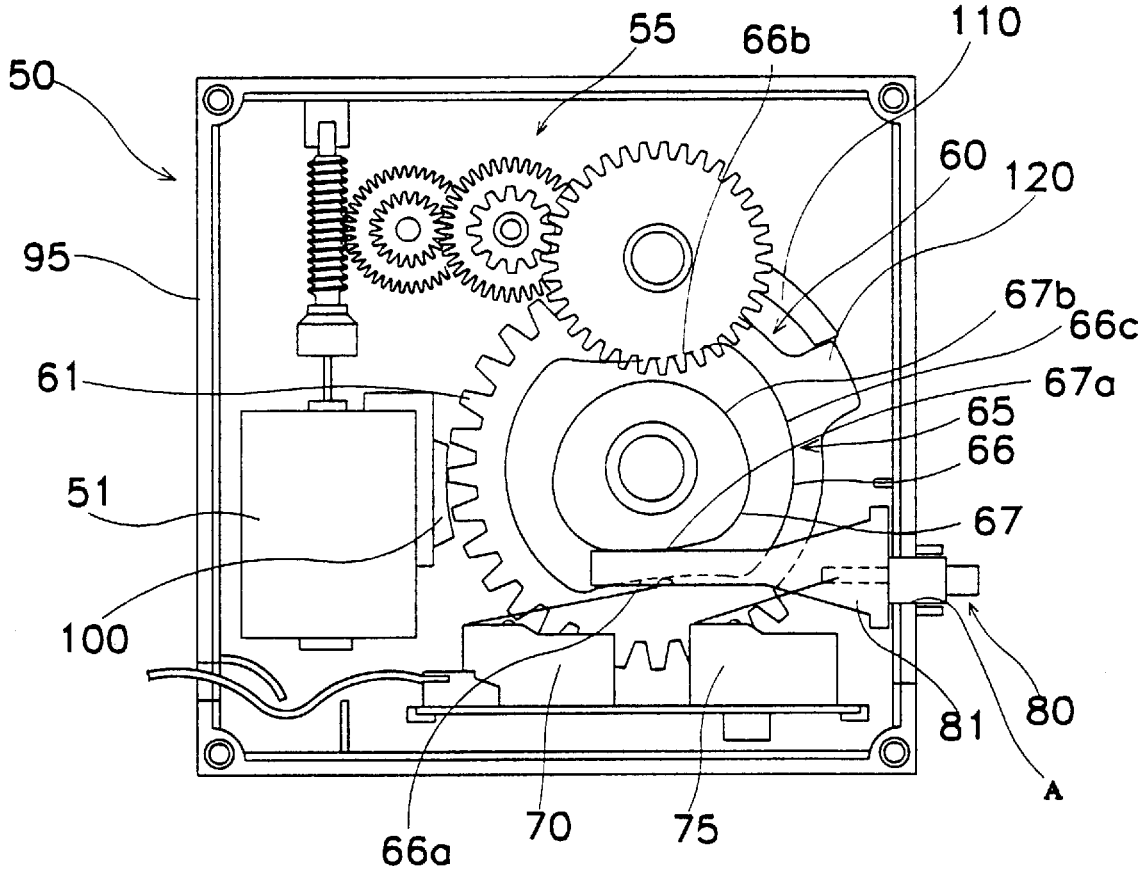
Figure 3:
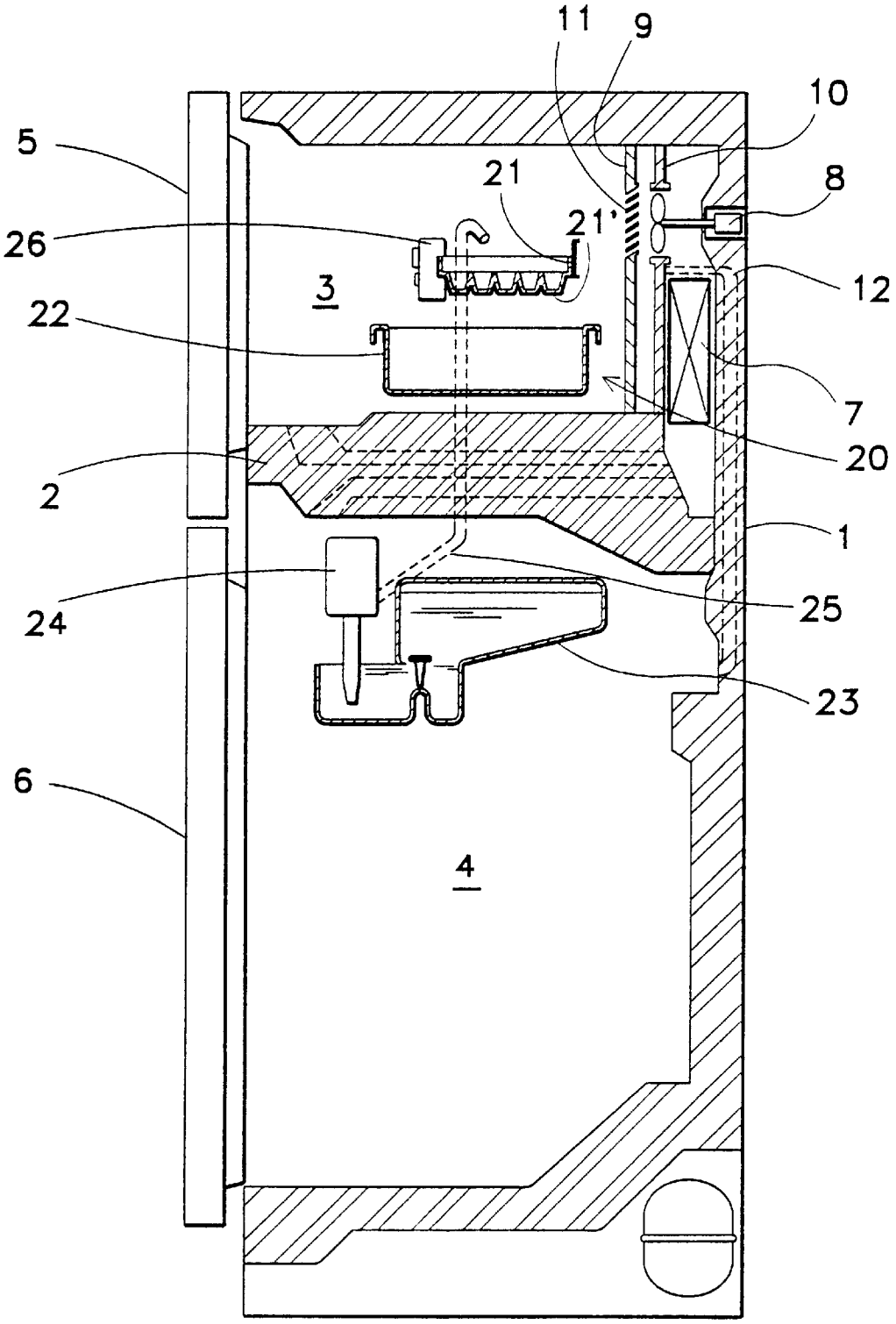
FIG.3 (PRIOR ART)
FIG. 3 is a longitudinal-sectional view of a conventional ice maker equipped refrigerator.
Figure 4:
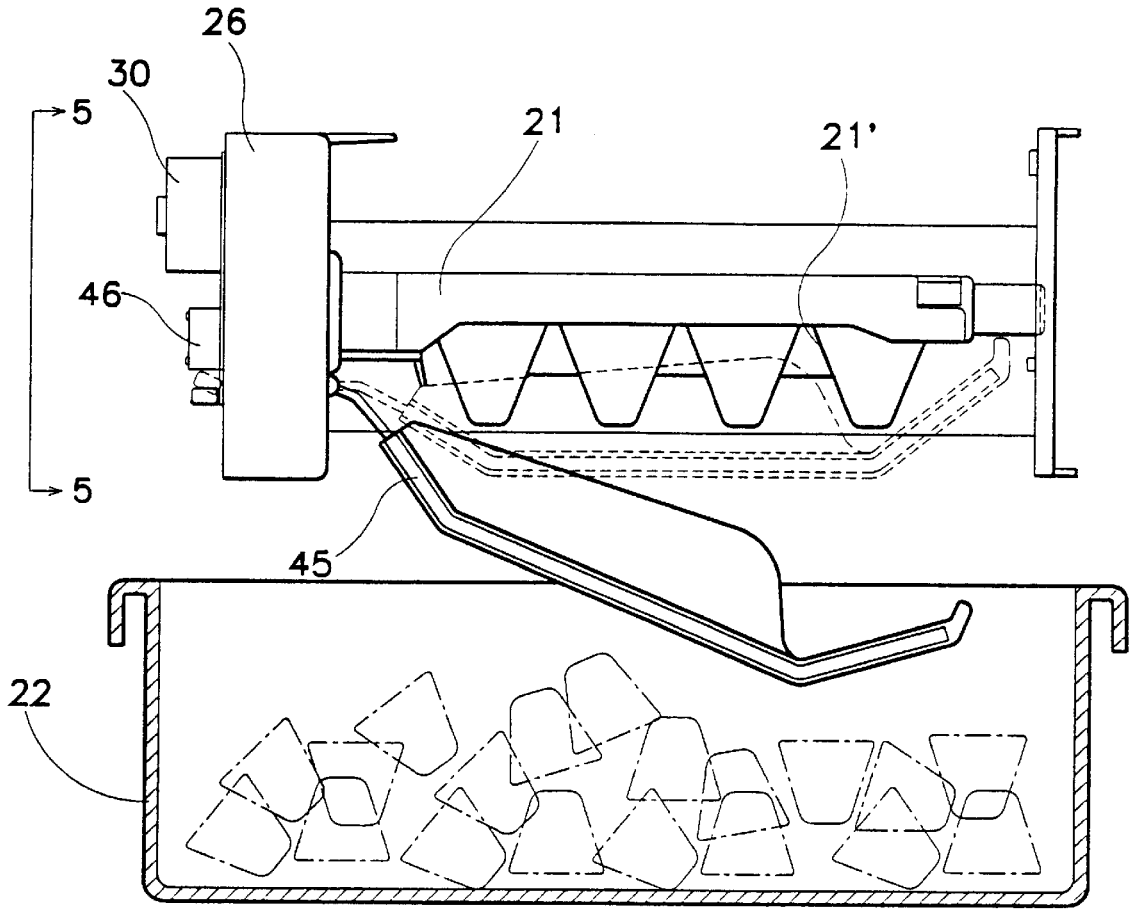
FIG. 4 (PRIOR ART)
FIG. 4 depicts a side view of an ice maker for a refrigerator according to a prior art.
Figure 5:
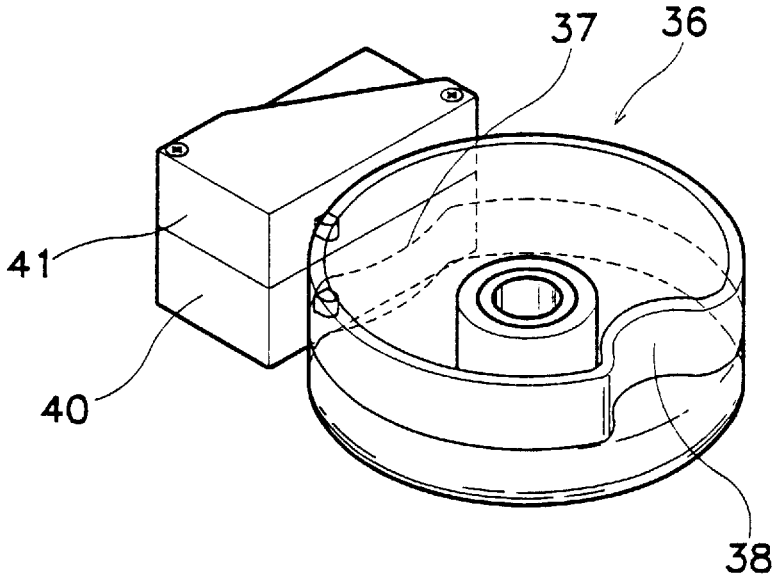
FIG.5 (PRIOR ART)
FIG. 5 is a perspective view of an operating member of the conventional ice maker as taken along line 5—5 in FIG. 4.
Figure 6:
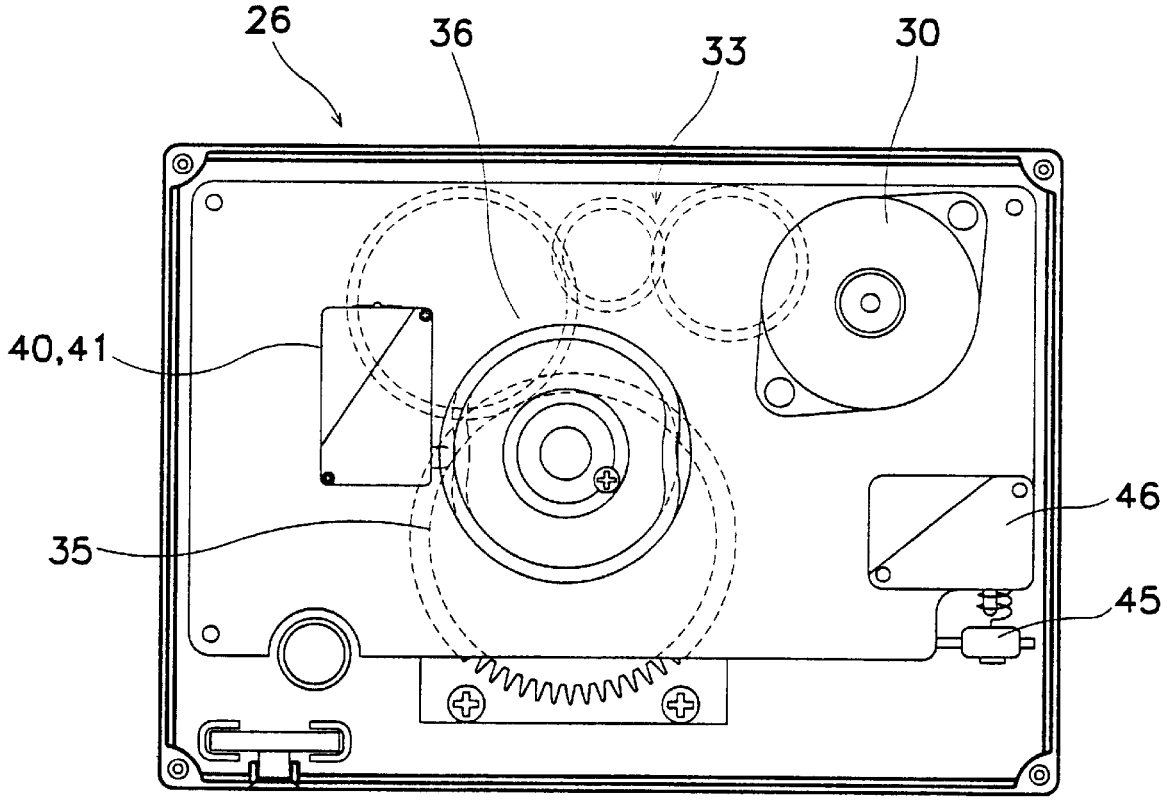
FIG.6 (PRIOR ART)
FIG. 6 is a cross-sectional view representing the operational relationship between a conventional cam gear and switches of FIG. 5.

Thus, the ice making container 21, the cam gear 60, the reduction gear 55, and the motor 51 become damaged. If either or both of the two switches 70 and 75 malfunctions while the ice making container 21 comes to the horizontal stop point, the second stopper 110 which is located slightly beyond the horizontal position of the ice making container 21 prevents the continuous rotation of the cam gear 60. In other words, as shown in FIG. 2E, the catch 120 abuts the first stopper 100 during the rotation of the cam gear 60 so that the cam gear 60 and the ice making container 21 do not rotate any further, thereby preventing the breakage of the components. The control portion (not illustrated) which detects the electrical overcurrent flowing into the motor 51, stops the motor 51.

Additionally, the above circumstance may arise during the device's normal operation. Should the quantity of ice cubes inside the ice reservoir 22 exceed an appropriate level while the cam gear 60 returns to its original position after the ice dropping mode to thereby prevent the second arm member 82 of the ice level checking lever 80 from moving downward, the ice level checking switch 75 would remain on regardless of the rotation of the cam gear 60. This also would occur if the path of the descending second arm member 82 is obstructed by a foreign object. Thus, the control portion would fail to detect the completion of the ice dropping mode. In this occasion, the catch 120 and the second stopper 110 prevent the cam gear 60 from rotating so that the motor 51 stops by aforementioned means. In such a manner, the control portion determines that the ice reservoir 22 is filled to capacity with ice cubes.

To summarize, if either of the switches 70,75 malfunctions or is defective when the cam gear and the ice making container have rotated maximally or returned to their horizontal position, the inventive ice maker can complete the ice making mode without error to thereby prevent the motor, the ice making container and the other components from being damaged. Therefore, the present invention can extend the ice maker's life span and enhance its reliability.

What is claimed is:

1. An automatic ice maker adapted for use in a refrigerator, comprising:

an ice container rotatable about an axis;

a motor;

a drive transmission mechanism interconnecting the motor and the container for rotating the container between an ice-making upright position and an ice-discharging inverted position;

a reservoir disposed below the container for receiving ice discharged therefrom;

a cam structure operably connected to the drive transmission mechanism to be rotated thereby during rotation of the container;

a switch arrangement operable by the cam structure to indicate a position of the container;

a controller operably connected to the motor and switch arrangement to shut off the motor when the container is in a desired one of its upright and inverted positions;

first and second stationary stop surfaces located for stopping the rotation of the container independently of the controller to prevent the container from rotating a substantial distance past the inverted and upright positions respectively; and third and fourth movable stop surfaces engageable with the first and second stop surfaces, respectively, the third and fourth movable stop surfaces connected to the drive transmission mechanism for movement therewith to terminate a transmission of a driving force to the container in response to engagement of either of the third and fourth stop surfaces with the first and second stationary stop surfaces, respectively.

2. The automatic ice maker according to claim 1 wherein the motor is connected to the controller to deliver thereto an overload condition when the stop structure stops the rotation of the container, to enable the controller to shut off the motor.

3. The automatic ice maker according to claim 1 wherein the cam structure includes a cam wheel driven by the motor and having first and second cams fixed thereon; the switch arrangement comprising first and second switches positioned to be operated by the first and second cams, respectively, the cam wheel carrying the third and fourth stop surfaces.

4. The automatic ice maker according to claim 1 further including a sensor for determining whether the reservoir is full and for actuating the second switch in response to sensing a reservoir-full condition, independently of the cam structure.

5. The automatic ice maker according to claim 1 wherein the drive transmission mechanism includes at least one gear, the third and fourth stop surfaces being formed on the gear.

* * * * *